US010232977B2

(12) United States Patent
Dahl et al.

(10) Patent No.: US 10,232,977 B2
(45) **Date of Patent: *Mar. 19, 2019**

(54) CAP WITH A TAMPER EVIDENCE AND A SPOUT

(71) Applicant: Tetra Laval Holdings & Finance S.A., Pully (CH)

(72) Inventors: Göran Dahl, Höör (SE); Bengt Håkansson, Sjöbo (SE)

(73) Assignee: TETRA LAVAL HOLDINGS & FINANCES S.A., Pully (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/822,842

(22) Filed: Nov. 27, 2017

(65) Prior Publication Data

US 2018/0079550 A1 Mar. 22, 2018

Related U.S. Application Data

(63) Continuation of application No. 13/697,480, filed as application No. PCT/EP2011/057886 on May 16, 2011.

(30) Foreign Application Priority Data

May 20, 2010 (SE) ..... 1000541

(51) Int. Cl.
*B65D 5/74* (2006.01)
*B65D 41/34* (2006.01)
*B65D 51/22* (2006.01)

(52) U.S. Cl.
CPC ..... *B65D 5/746* (2013.01); *B65D 41/3404* (2013.01); *B65D 41/3423* (2013.01);
(Continued)

(58) Field of Classification Search
CPC ..... B65D 7/28; B65D 41/32; A47G 19/027
(Continued)

(56) References Cited

U.S. PATENT DOCUMENTS 4,181,232 A 1/1980 Bellamy et al.
4,506,795 A 3/1985 Herr
(Continued)

FOREIGN PATENT DOCUMENTS

GB 2 080 775 A 2/1982
JP 57-159647 U 10/1982
(Continued)

OTHER PUBLICATIONS

International Search Report (PCT/ISA/210) dated Nov. 24, 2011, by the European Patent Office as the International Searching Authority for International Application No. PCT/EP2011/057886.
(Continued)

*Primary Examiner* — Anthony Stashick
*Assistant Examiner* — Raven Collins
(74) *Attorney, Agent, or Firm* — Buchanan Ingersoll & Rooney PC

(57) ABSTRACT

A cap arranged to interact with a spout. The cap includes a top section, a side wall section attached to the top section and a tamper element attached to the side wall section in a tearing interface. The tearing interface may be provided with a weakening line that is arranged to break when the cap is unscrewed such that the tamper element is separated from the side wall section. The cap further includes at least one resilient cutting element arranged to the side wall. The at least one resilient cutting element is arranged to cut off a membrane of the spout when the cap is unscrewed. The cap is arranged such that the weakening line is arranged to break before the membrane of the spout is cut off when the cap is being unscrewed from the spout.

7 Claims, 3 Drawing Sheets

(52) U.S. Cl.
CPC .... *B65D 51/228* (2013.01); *B65D 2251/0015* (2013.01); *B65D 2251/0093* (2013.01)

(58) Field of Classification Search
USPC ..... 220/574, 278; 215/257
See application file for complete search history.

(56) References Cited

U.S. PATENT DOCUMENTS

| | | | | |
|---|---|---|---|---|
| 4,526,279 | A | 7/1985 | Weiler | |
| 5,090,581 | A * | 2/1992 | Rose | B65D 51/228 215/253 |
| 5,255,813 | A | 10/1993 | Berggren et al. | |
| 8,251,236 | B1 * | 8/2012 | Robinson | B65D 41/3428 215/276 |
| 2003/0102280 | A1 | 6/2003 | Odet et al. | |
| 2005/0005757 | A1 | 1/2005 | Kowal | |
| 2008/0083694 | A1 * | 4/2008 | Ammann | B65D 51/228 215/316 |
| 2009/0184082 | A1 | 7/2009 | Antler et al. | |
| 2010/0258563 | A1 | 10/2010 | Parrinello et al. | |

FOREIGN PATENT DOCUMENTS

| | | | |
|---|---|---|---|
| JP | 6-69152 | U | 9/1994 |
| JP | 2000-168735 | A | 6/2000 |
| JP | 2002-205752 | A | 7/2002 |
| JP | 2003-519602 | A | 6/2003 |
| JP | 2009-534258 | A | 9/2009 |
| JP | 2010-528946 | A | 8/2010 |
| WO | WO 2008/004932 | A1 | 1/2008 |
| WO | WO 2008/148764 | A2 | 12/2008 |

OTHER PUBLICATIONS

Office Action dated Nov. 3, 2015, by the European Patent Office in corresponding European Patent Application No. 11 719 827.5-1707 (8 pages).

* cited by examiner

CAP WITH A TAMPER EVIDENCE AND A SPOUT

CROSS-REFERENCES TO RELATED APPLICATIONS

This application is a continuation application of U.S. patent application Ser. No. 13/697,480 filed on Nov. 12, 2012, which is a U.S. National Stage application based on International Patent Application No. PCT/EP2011/057886 filed on May 16, 2011, which claims priority to Swedish Patent Application No. 1000541-1 filed on May 20, 2010, the entire content of all three of which is incorporated herein by reference.

TECHNICAL FIELD

The invention generally relates to the field of packaging technology. More particularly, the invention relates to a cap with a tamper evidence, a spout arranged to interact with the cap, a bottle provided with the spout, a method for applying the cap onto the spout and a method for packaging liquid food in a bottle.

BACKGROUND DISCUSSION

Food safety is a major concern throughout the world. In order to be sure that food produced and packaged in one place and consumed in another place are safe to consume, the food must be packed in hygienic conditions in packages capable of keeping these conditions until the packages are opened. Thus, there is a need to know if the packages have been opened or not.

In order to be able to know if a package has been opened or not so-called tamper evidence solutions have been developed. For instance, it is known to provide bottles with tamper rings attached to the caps. Most often the tamper rings are made as parts of the caps, more particularly the lowermost parts of the caps. Further, in order to make it possible to separate the caps from the tamper rings weakening lines are made between the caps and the tampering rings. The spouts, on the other hand, are provided with tamper flanges in order to make the tamper rings stay on the spouts when the caps are unscrewed. The caps with the tamper rings and the tamper flanges may be designed such that the tamper rings can be pulled over the tamper flanges when the caps are applied onto the spouts for the very first time, that is, when packaging liquid food in the bottles.

Although the tamper evidence solutions of today are safe there is still a need for even safer tamper evidence solutions.

SUMMARY

It is, therefore, an object of the present invention to overcome or alleviate the above described problems.

In general it has been realized that by having a cap provided with a tamper element arranged to be separated when the cap is unscrewed and a spout comprising a neck provided with a membrane arranged to be separated from the neck when the cap is unscrewed, two different processes are performed when the cap is unscrewed. Since the product of the package is kept safely as long as the membrane is not separated from the neck, the cap and spout can be arranged such that the tamper element is separated from the cap before the membrane is separated from the neck, that is the process of separating the tamper element from the cap is arranged to be performed before the process of separating the membrane from the neck. This has the advantage that a very reliable tamper evidence may be achieved.

Further, in general, it has been realized that by forming a sleeve of a carton-based laminate, closing a first end of the sleeve by molding a spout with a membrane thereto, filling product into a second end of the sleeve and sealing the second end of the sleeve, a closed package with very good food safety properties is achieved, i.e. the risk that unwanted objects get into the package and affect the product is very low. One reason for these good food safety properties is that the package is held top down when being filled with product, which has the positive effect that if the spout is not completely closed product will flow through areas of the spout not sufficiently closed. Thus, packages not having good food safety properties due to insufficient spout properties will be detected. If post-applying the membrane on the spout, that is, applying the membrane after having filled the package with product, which is the case for PET bottles, insufficient closure between the membrane and the spout cannot be detected as easily since the package is held bottom down when being filled. Thus, by producing the spout including the membrane in one piece before introducing product improves the food safety properties.

Further, by using a cap with resilient cutting elements, the spout is unaffected when applying the cap onto the spout. Hence the good food safety properties can be retained when using such a cap. Moreover, by post-applying the caps a more flexible system is achieved since different caps may be applied onto the same spout, thereby providing for a possibility to differentiate the products without changing the spout, which in turn implies less changed machine settings.

Apart from having good food safety properties it is important that the indication that the food is safe to consume is truly reliable. More particularly, it is important that the good food safety properties remain as long as the tamper element is attached to the cap. Therefore, by adapting the cap such that a tamper element attached to the cap is broken before the membrane of the spout is cut off the indication that the food is safe to consume is truly valid since the package is closed as long as the tamper element is fully attached to the cap. In contrast, if no membrane is used or if a post-applied membrane is used, unwanted objects might get into the product if the cap is slightly opened such that the tamper element is attached to the cap, but nevertheless leaving room for unwanted objects to get into the product. This is of special relevance if a resilient tamper element projection is used since such a tamper-proof solution may be unaffected even if the cap is slightly unscrewed. Thus, by keeping this in mind, the cap may be made such that the tamper element is released well before the membrane is fully cut off, thereby ensuring true food safety indication.

As can be readily understood the tamper element does not have to be fully released before the process of cutting off the membrane is started. In other words, good food safety properties are achieved as long as the process of cutting off the membrane is started after the process of releasing the tamper element from the rest of the cap has come so far that it can be seen by a consumer.

According to a first aspect a cap is provided. The cap is arranged to interact with a spout. The cap comprises a top section, a side wall section attached to said top section, a tamper element attached to said side wall section in a tearing interface, said tearing interface being provided with a weakening line, said weakening line being arranged to break when said cap is unscrewed such that said tamper element is separated from said side wall section, at least one resilient cutting element arranged to said side wall, said at least one resilient cutting element being arranged to cut off a membrane of said spout when said cap is unscrewed, wherein said cap is arranged such that said weakening line is arranged to break before said membrane of said spout is cut off when said cap is being unscrewed from said spout.

The cap may be molded in one piece.

The tamper element may be a tamper ring.

A tamper element projection may be attached to said tamper element. An advantage of this is that the tamper element may be prevented from following the rest of the cap when the cap is unscrewed. Further, the tamper element projection may be resilient such that the tamper element may be pulled over a tamper element flange of the spout the very first time the cap is applied onto the spout.

The cap may be made of polypropylene. Since polypropylene is harder than High Density PolyEthylene (HDPE) a cap made of polypropylene may advantageously be used with a spout made of HDPE.

According to a second aspect it is provided a spout arranged to interact with a cap. The spout comprises a membrane, a neck attached to said membrane in a cut off area, said membrane extending outside said neck such that a membrane projection is formed, said membrane projection being arranged to direct at least one resilient cutting element of said cap radially inwards when said cap is unscrewed such that said membrane can be separated from said neck, a tamper element holder arranged to prevent a tamper element of said cap from being unscrewed together with said cap, wherein said spout is arranged such that said tamper element is separated from a side wall of said cap before said membrane is separated from said neck when said cap is being unscrewed from said spout.

The spout may be molded in one piece. An advantage of molding the spout in one piece is that a safer package may be achieved. For example, the risk that unwanted objects enter the package via the top is decreased.

The spout may comprise a tamper element flange for preventing a tamper element of said cap from following the rest of said cap when said cap is being unscrewed.

The spout may be made of HDPE. An advantage of having the spout made of HDPE is that the shelf life of the liquid food stored in a bottle provided with the spout may be prolonged since the liquid food is less affected by the outside conditions due to the more resistant material in the spout. More particularly, a spout made of HDPE has a lower Oxygen Transmission Rate (OTR) than, for instance, a spout made of Low Density PolyPropylene (LDPE), which has the positive effect that less oxygen will enter the bottle or the package provided with the spout through the spout, which in turn has the effect that the liquid food in the bottle or package may be stored for a longer period of time without being unsafe to consume.

Another advantage of having a spout made of HDPE is that a more robust package is achieved having the effect that more packages or bottles provided with spouts made of HDPE can be piled on top of each other.

According to a third aspect a bottle is provided. The bottle comprises a cap according to the first aspect and a spout according to the second aspect.

The bottle may comprise a body section made of carton-based laminate, and a top section made of plastics, said top section comprising said spout.

According to a fourth aspect a method for applying a cap according to the first aspect to a spout according to the second aspect. The method comprises applying said cap onto said spout such that said at least one resilient cutting element of said cap is pulled over said membrane projection.

According to a fifth aspect a method for packaging liquid food in a bottle is provided. The method comprising forming a body portion of said bottle in the form of a sleeve of a carton-based laminate, forming a top section of said bottle, said top section comprising a spout according the second aspect, joining said top section to said body portion, filling said bottle with liquid food via an open end of said bottle, sealing said open end of said bottle, and applying a cap according to the first aspect onto said spout according to the fourth aspect.

The step of forming said top section of said bottle may comprise molding said spout. The step of forming a top section of said bottle and the step of joining said top section to said body portion may be performed simultaneously in a molding step.

Further, an upper spout section comprising said membrane may be pre-made and said step of forming said top section of said bottle may comprise molding a main spout section such that said upper part section is joined to said body portion.

An advantage of having an upper spout section pre-made is that the upper spout, which may comprise threading and/or said membrane projection, can be quality controlled before being input to the filling machine.

Further, an advantage is that the upper part section may be made in a material different from a material used for the main spout section resulting in that the material used for the main spout section may be chosen such that a very fast molding process is made possible and the material chosen for the upper part section may be chosen such that proper threading and/or membrane projection is made possible.

Further, an advantage is that different material may be chosen for the upper part section and the main spout section taking into account that the upper part section is covered by the cap. For instance, the material chosen for the main spout section may be a material with good light barrier properties ensuring that a small amount of light is transmitted into the product. The material chosen for the upper part section may be a material with less good light barrier properties. However, by using a cap made of a material with good light barrier properties and by covering the upper part section with the cap the light barrier properties will be kept at a high level.

The cap may be applied onto said upper spout section before said upper part section is joined to said body portion.

An advantage of applying the cap to the upper spout section before said upper part section is joined to said body portion is that upper spout sections with caps applied may be pre-made and sent to the site where the filling machine is placed. An effect of this is that no cap application machine is needed at the site, thereby reducing the initial cost for setting up a packaging system.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, wherein.

DETAILED DESCRIPTION

Figure 1:
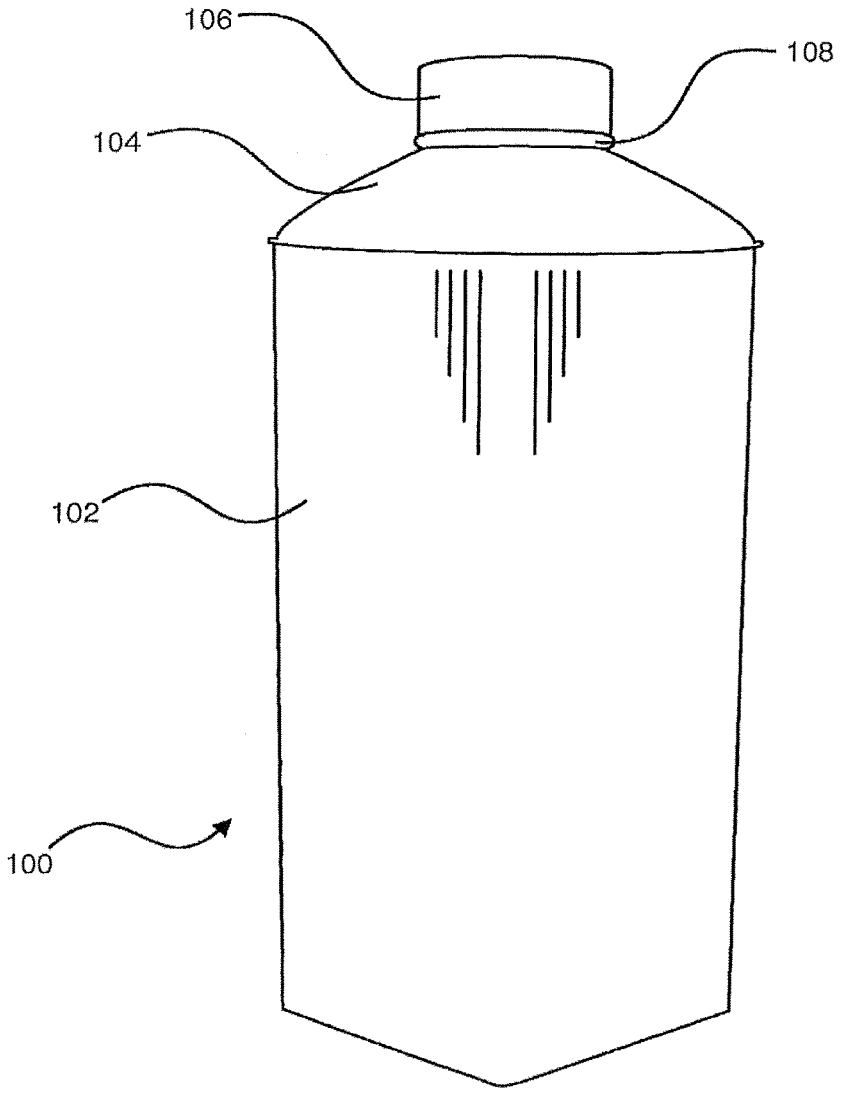
FIG. 1 illustrates a carton-based bottle having a top section made of plastic and a body made of carton-based laminate.

FIG. 1 illustrates an example of a bottle 100. The bottle 100 comprises a body portion 102, which may be made of a carton based laminate, a top portion 104, which may be made of plastic, a cap 106 provided with a tamper ring 108.

This type of package may be made by first forming a sleeve of the carton-based laminate. In a second step, the plastic top can be formed in a molding step. The plastic top may comprise a shoulder section, a neck portion and a membrane. The shoulder portion may be arranged to join the sleeve, which form basis for the body portion, to the neck portion. In a case where the spout is arranged to interact with a screw cap the neck portion may be provided with threadings or a cam curve. The membrane may be a lid joined to the neck portion. In this way the plastic top may be molded in one piece.

In a next step the sleeve with the top portion 104 joined thereto can be filled with product with the top portion placed downwards. After being filled the open end of the sleeve may be sealed and folded to a flat bottom and a cap may be applied, e.g. by screwing the cap onto the neck portion, such that a package according to FIG. 1 is formed.

Alternatively, for instance if the package is a blow molded plastic bottle, the membrane may be joined to the neck portion after the package has been filled with product.

Figure 2A:
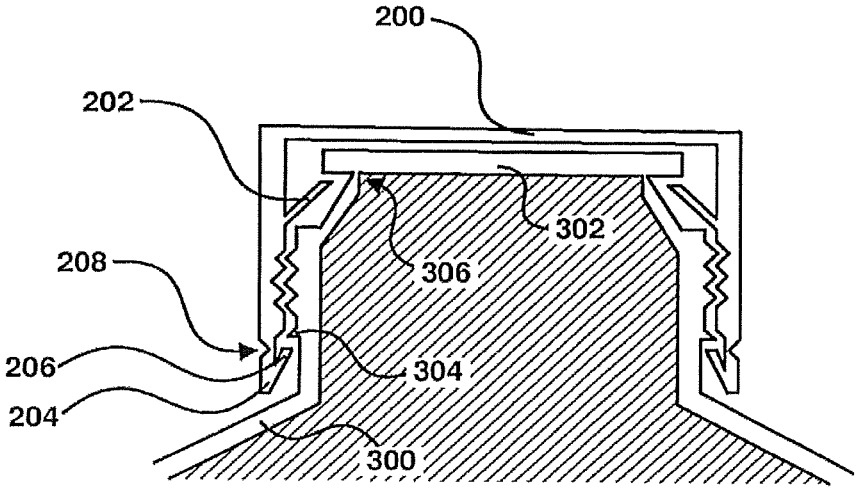
FIG. 2 A-C illustrates a tamper evident opening device comprising a cap and a spout.
Figure 2B:
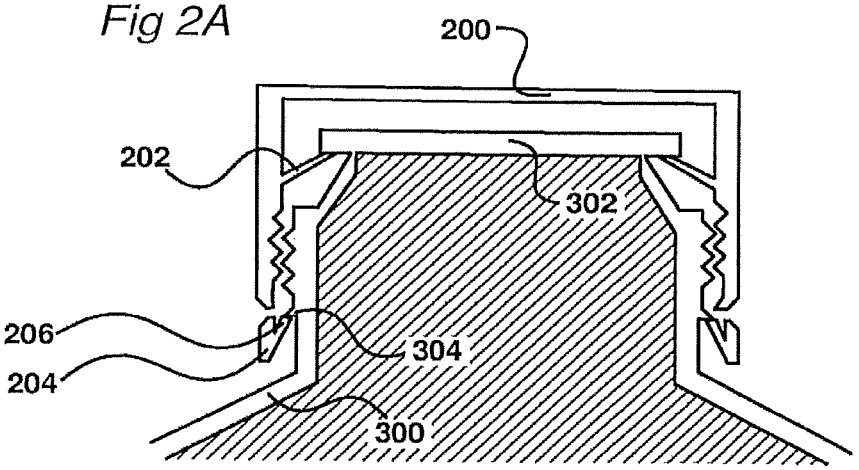

FIG. 2 A-C illustrates three stages of an opening process of a cap and spout according to a first embodiment. In the first and second step, illustrated in FIG. 2A and FIG. 2B, the interior of the package is unaffected, that is no germs or other unwanted objects may find their ways into the package. This is herein illustrated by a shaded interior.

In a first stage, or an initial step, illustrated in FIG. 2A, a cap 200 is placed on a spout 300. The cap 200 can be provided with flexible knives 202 or other cutting elements. The flexible knives 202 can be flexible in the sense that they can be folded upwards when the cap is screwed onto the spout such that the flexible knives can be pulled over a membrane 302 of the spout 300 when the cap 200 is screwed onto the spout 300 for the first time. As illustrated, an end of the membrane 302 may extend outside the neck portion forming a membrane projection. With the help of the membrane projection the flexible knives 202 can be directed radially inwards when the cap 200 is unscrewed for the first time.

Further, the cap 200 may be provided with a tamper ring 204, or any other tamper element. In order to provide for that the tamper ring 204 is prevented from following the rest of the cap 200 when it is unscrewed, the tamper ring 204 may be provided with a tamper ring projection 206 arranged to interact with a tamper ring flange 304 on the spout 300. The tamper ring projection 206 may be resilient such that the cap 200 including the tamper ring 204 may be screwed onto the spout 300. Further, in order to facilitate that the tamper ring 204 is separated from a side wall of the cap 200, a weakening line 208 may be provided in the interface between the tamper ring 204 and the rest of the cap 200. In the same way, in order to facilitate that the membrane 302 is separated from the rest of the spout, a membrane weakening line 306 may be provided in the interface between the membrane 302 and the spout 300.

In FIG. 2B a second stage, or an intermediate stage, of the process of unscrewing the cap 200 is illustrated. As illustrated, the tamper ring projection 206 can hook to the tamper ring flange 304 with the effect that the tamper ring 204 is prevented from following the rest of the cap, in turn having the effect that the tamper ring 204 is separated from the rest of the cap 200.

As illustrated, the flexible knives 202 have been directed radially inwards due to that the cap has been moved upward, the design of the neck portion below the membrane projection and the design of the flexible knives 202. However, the cap 200 and the spout 300 can be designed such that no penetration of the membrane weakening line 304 occur before the tamper ring 204 is separated from the rest of the cap 200. This can be made, for instance, by choosing appropriate length of the neck portion, length of the membrane projection and length of the flexible knives 202.

Figure 2C:
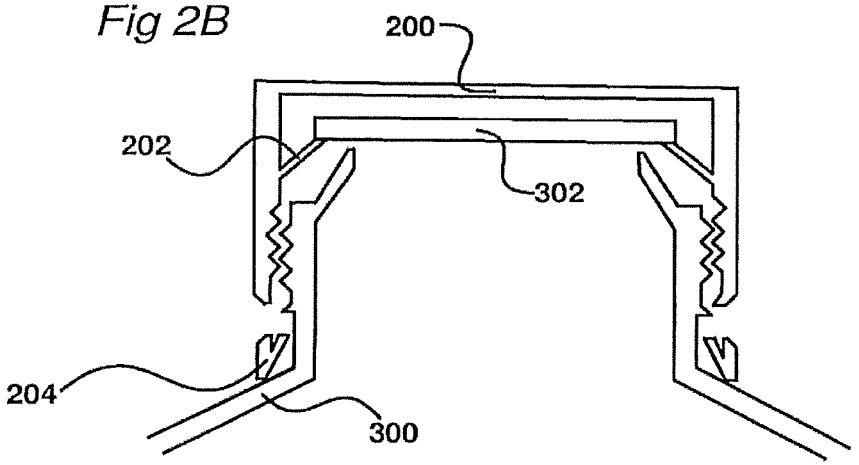

In FIG. 2C a third stage, or an open stage, is illustrated. The flexible knives 202 have cut off the membrane 302. As illustrated, after having cut off the membrane 302 it can be held by the flexible knives within the cap 200, thereby leaving no waste when opening the package.

In order to provide for that the cap easily can cut off the membrane of the spout the cap may be made of a harder material than the spout, e.g. the cap may be made of polypropylene and the spout may be made of High Density PolyEthylene (HDPE). However, other plastic material suitable to be used for liquid food may be used as well, such as Low Density PolyEthylene (LDPE) and Medium Density PolyEthylene (MDPE).

Figure 3A:
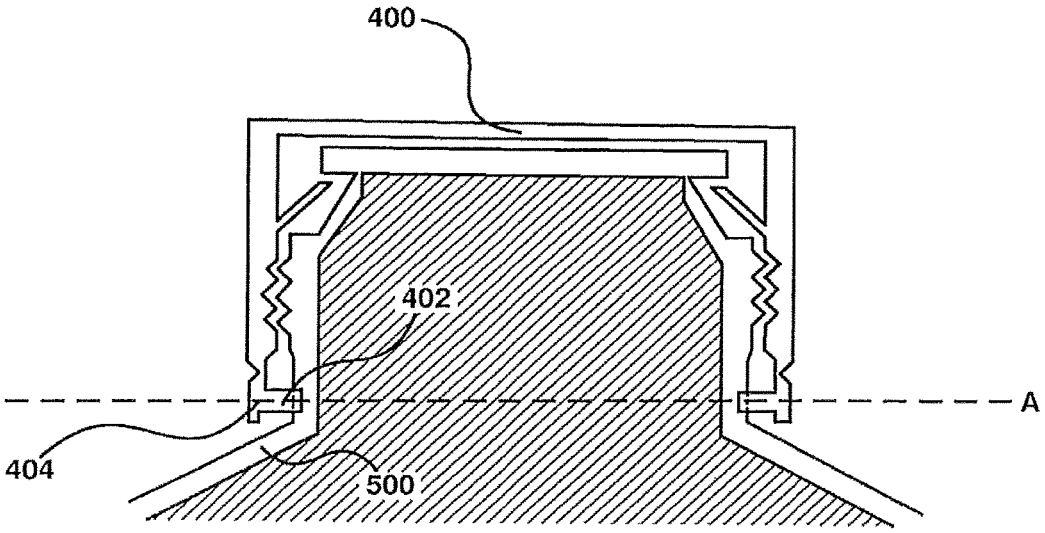
FIG. 3 A-B illustrates another tamper evident opening device comprising a cap and a spout.
Figure 3B:
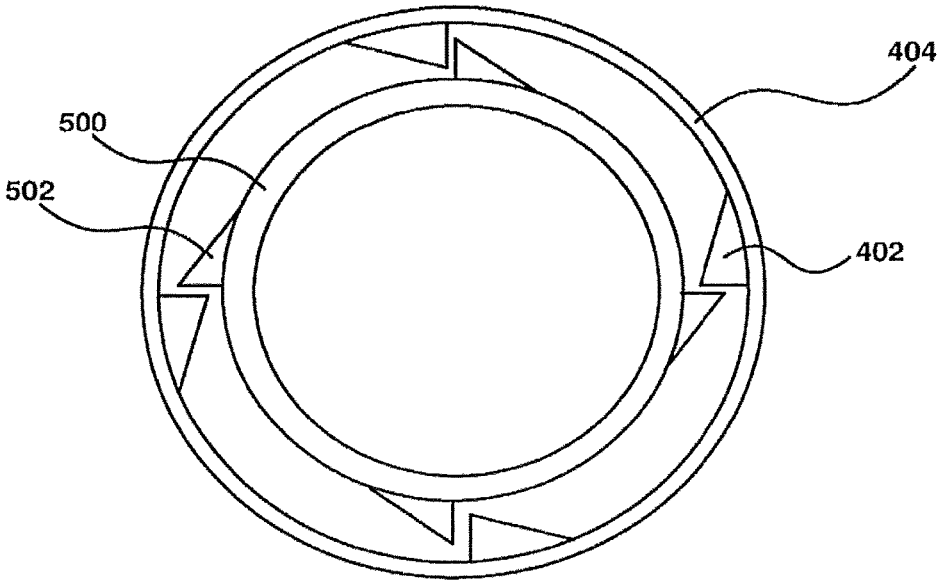

FIG. 3A-B illustrates another embodiment having a different tamper solution otherwise similar to the embodiment illustrated in FIG. 2A-C. Unlike the tamper ring solution illustrated in FIG. 2 A-C, which is based on that the tamper ring 204 is separated from the rest of the cap 200 due to a vertical force generated when the cap 200 is unscrewed, the tamper solution illustrated in FIG. 3A-B is based on a horizontal force generated when a cap 400 is unscrewed from a spout 500.

FIG. 3B illustrates a cross-section of the cap 400 and the spout 500 along a line A. As illustrated, the cap 400 can be provided with wedge-shaped elements 402 and the spout 500 can be provided with corresponding wedge-shaped elements 502. The wedge-shaped elements 402 can be resilient such that when the cap 400 for the first time is screwed onto the spout 500 the wedge-shaped elements 402 are pulled over the corresponding wedge-shaped elements 502. This has the effect that when the cap 400 is unscrewed the wedge-shaped elements 402 will be prevented to follow the cap 400 by the corresponding wedge-shaped elements 502, which in turn has the effect that the tamper ring 404 is separated from the rest of the cap 400.

Moreover, although not illustrated, according to yet another embodiment the cap may be provided with a tamper ring flange and the spout may be provided with a spout flange having a diameter greater than a diameter of the tamper ring flange. After having applied the cap onto the spout these are placed in a hole, having a diameter less than both the tamper ring flange and the spout flange, of the carton-based laminate from the inside of the bottle such that the tamper ring flange and the spout flange are both in contact with an inside of the carton-based laminate. Then, e.g. by using UV light, the tamper ring flange and the spout flange can be welded to the package. In the similar way, as illustrated in the FIG. 3A-C the cap may be separated into a cap portion and a tamper ring portion when the cap is unscrewed from the spout. This separation may be facilitated by weakening lines.

Further, as can be readily understood, the general principle of this invention can be applied to all sorts of packages provided with opening devices.

The invention has mainly been described above with reference to a few embodiments. However, as is readily appreciated by a person skilled in the art, other embodiments than the ones disclosed above are equally possible within the scope of the invention, as defined by the appended patent claims.

What is claimed is:

1. A cap arranged to interact with a spout, said cap comprising:

a top section;

a side wall section attached to said top section;

at least one resilient cutting element fixed to said side wall, said at least one resilient cutting element being configured to cut off a membrane of said spout when said cap is unscrewed;

said at least one resilient cutting element possessing a first end and a second end, the first end being fixed to the side wall section of the cap and the second end being a free end configured to cut off the membrane of the spout;

between the first and second ends of the at least one resilient cutting element, the at least one resilient cutting element is devoid of structure that contacts the membrane when the second end of the resilient cutting element cuts off the membrane of the spout during unscrewing of the cap;

said at least one resilient cutting element being directed radially inwards by contacting a membrane projection, said membrane projection being formed by an end of said membrane extending radially outside of said spout; and said second end of said at least one resilient cutting element extending towards said top section of said cap after cutting off said membrane of said spout.

2. The cap according to claim 1, wherein said cap is molded in one piece.

3. The cap according to claim 1, wherein said cap is made of polypropylene.

4. The cap according to claim 1, wherein the at least one resilient cutting element is configured to contact the membrane projection before contacting any other surface of said spout.

5. The cap according to claim 1, further comprising:

a tamper element attached to said side wall section in a tearing interface, said tearing interface being provided with a weakening line, said weakening line being arranged to break when said cap is unscrewed such that said tamper element is separated from said side wall section; and said at least one resilient cutting element possessing a length such that said weakening line breaks before said membrane of said spout is cut off by said at least one resilient cutting element.

6. The cap according to claim 5, wherein said tamper element is a tamper ring.

7. The cap according to claim 5, wherein a tamper element projection is attached to said tamper element.

* * * * *